United States Patent [19]

Ritter

[11] 4,014,465

[45] Mar. 29, 1977

[54] PAINT CAN POUR SPOUT

[76] Inventor: John C. Ritter, 12645 Duchess, Detroit, Mich. 48224

[22] Filed: Sept. 2, 1975

[21] Appl. No.: 609,383

[52] U.S. Cl. ..... 222/563; 222/570; 220/90

[51] Int. Cl.[2] ..... B65D 25/48

[58] Field of Search ..... 222/570, 566, 567, 563; 220/284, 90, 354

[56] References Cited

UNITED STATES PATENTS

| | | | |
|---|---|---|---|
| 2,591,482 | 4/1952 | Weltlich | 220/90 |
| 2,672,256 | 3/1954 | Sebell | 220/354 |
| 2,960,257 | 11/1960 | Sasse | 222/570 X |
| 3,329,307 | 7/1967 | Jacobson | 220/90 |
| 3,463,366 | 8/1969 | Spencer | 222/570 |

*Primary Examiner*—Robert B. Reeves
*Assistant Examiner*—Frederick R. Handren
*Attorney, Agent, or Firm*—Basile, Weintraub and Vanophem

[57] ABSTRACT

A pour spout and paint brush wiper attachable on paint containers. The pour spout has a circular planar member with a square aperture, two edges of which are integral with a pouring spout to facilitate the pouring of paint from the paint container. The circular edge of the planar member has an inverted channel-shaped flange capable of being conformingly snapped over the securing bead of a paint container, while the upper surface of the planar member has a raised rim circumscribing the square aperture and terminating in an integral connection with the spout to prevent the spilling of paint beyond the edge of the pour spout.

1 Claim, 4 Drawing Figures

PAINT CAN POUR SPOUT

BACKGROUND OF THE INVENTION

I. Field of the Invention

The present invention relates generally to pour spouts for fluid containers and, particularly, to a pour spout and paint brush wiper for paint cans and similar containers.

II. Description of the Prior Art

Pour spouts, including some provided with brush holders attachable to a particular kind and size of fluid container, are generally known to those skilled in the art. The problem with these prior art articles is that no provision is made for simple entry into the paint container with a paint brush for purposes of wetting the brush without the necessity of removing the paint spout or pourer. Many such prior art containers for paint, stain, lacquer, varnish, and similar products are constructed with a groove in the upwardly facing edge of the container for receiving a cover having a flange such that, when the cover is placed on the container and pressed down, the flange is forced into the groove. This construction creates a seal when the cover is in place such that the contents of the container are not exposed to the atmosphere as exposure of the contents should be avoided since it may lead to evaporation of the contents or cause a thick film to form on the contents. In either event, waste is the result. Also, if a film forms and is not properly and completely removed, the rest of the contents carry pieces of the film which interferes with the proper use and application of the contents. Various methods have been tried to keep the groove in the upward-facing flange of the container from filling up with container contents (particularly those contents which are applied with a brush) during use and pouring to prevent spilling and running over the sides. Cleaning the edges with a brush used for applying the contents is one popular means for dealing with the problem. Another means for dealing with the problem is tapping a plurality of nail holes or other apertures in the bottom of the groove so that the contents which get into the groove will drip or flow through the apertures back into the container. Such solutions to the problems as are stated above partially solve the problem, but splattering still occurs when the lid or cover is pressed down in place. Also, after the can has been closed for a time, the contents remaining in the groove dries and causes the cover or lid to stick when subsequent attempts to remove the cover are made. Examples of prior art lids, spouts, and the like which have been suggested for solving the aforementioned are disclosed and illustrated in U.S. Pat. Nos. 3,309,000; 3,596,813; and 3,844,457.

SUMMARY OF THE INVENTION

The present invention, which will be described subsequently in greater detail, comprises a simple pouring lid which may be easily attached to a container lip and which snaps down over the outwardly facing edge of the container when the same is in use; thus preventing the contents from entering the sealing groove. The lid is so constructed as to be shaped to be inclined both outwardly and inwardly over the edge of the container so as to completely cover and enclose the container lip. The lid further comprises a square aperture which facilitates a brush wiping against the same to permit the contents to run back down into the can. The lid further comprises a pouring spout which permits the transferring of the liquid from one container to another without any waste of liquid through spillage or the like.

It is therefore an object of the present invention to provide a pour spout lid readily attachable to and removable from fluid containers.

It is another object of the present invention to provide a pouring spout lid readily attachable to and removable from a fluid container without leaving any of the fluid in an internal groove or external lip or on the outer surface of the container.

It is still a further object of the present invention to provide such a pour spout lid having a simple and unique means for wiping a brush to remove excess liquid therefrom.

Other objects, advantages, and applications of the present invention will become apparent to those skilled in the art of pour spout lids for fluid containers when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and in which.

DESCRIPTION OF THE PREFERRED EMBODIMENT

Figure 1:
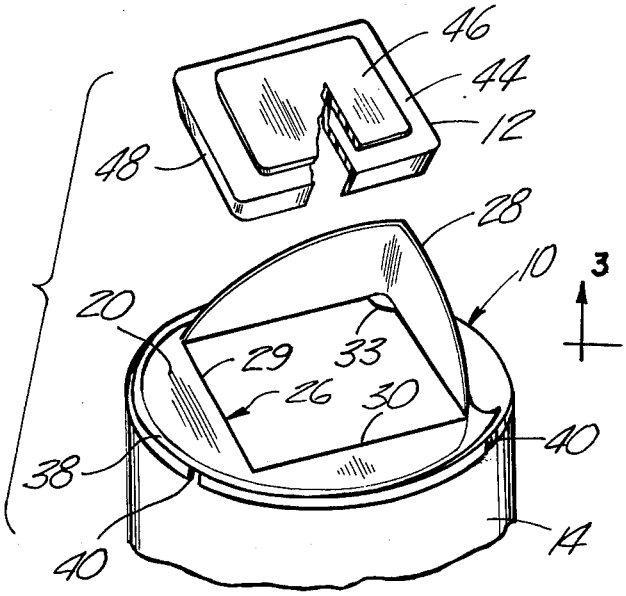
FIG. 1 is a exploded perspective view of a removable pouring spout lid and cover for a container which is constructed in accordance with the principles of the present invention.

Referring now to the drawing and, in particular, to FIG. 1 wherein there is illustrated one example of the present invention in the form of a pour spout and brush wiping lid 10 including a cover 12. The lid 10 is adapted to be attached to a can 14. The lid 10 can be readily applied to and removed from the can 14 while providing a simple means for effectually stirring the contents of the can 14 and without fear of spilling the contents. The lid 10 also functions as a pouring spout so as to enable one to pour with the aid of a properly oriented spout. All of this is accomplished in such a manner as to provide the capability of expedient use while overlaying and covering the rim channel or groove of the paint can and guard against leakage by reason of its mode of mounting on the top of the can 14.

It should also be understood by those skilled in the art that, although a circular can is disclosed, other cans of different shapes may be utilized in conjunction with the inventive lid 10, as the lid 10 may have its shape varied so as to accommodate such varying shaped cans; and while the present invention is described in conjunction with a paint can and the uses associated with such paint cans, it should also be understood that the inventive lid 10 may be used in conjunction with other cans of the type that may be construed as a container for ready-to-use fluid or liquid commodities such as enamel, varnish, plastic resins, and so forth. However, to simplify the description of the present inventive lid 10, the same will be described in conjunction with the circular paint can 14.

The top of the paint can 10 has a conventional, internal annulus or rim 16 which is an integral part of the mouth or top of the can 12 and which is provided with the customary groove or channel 18 to accommodate an insertable and removable rim on the so-called friction type lid (not shown).

The inventive lid 10 is adapted to cooperate with the paint rim 16 in such a manner as to provide a fluid seal around the rim 16 to prevent the entry of paint into the circular groove 18.

The inventive pour spout and brush-wiping lid 10 may be stamped from metal; however, it is preferable that the lid 10 be formed from a plastic material such as a polyethylene or suitable grade of rubber. It can be manufactured to fit any desired size of can but is primarily, but not necessarily, designed and adapted for standard friction lid type cans in half-pint, pints, quarts, and gallon sizes.

The pour spout and brush-wiping lid 10 comprises a planar member 20 which is circularly shaped and has an outer circular flange 22 which is arranged in outwardly spaced radial relationship with respect to an inner circular flange 24 and cooperates with the inner flange 24 for engaging, respectively, the outer and inner edges of the paint can rim 16 so as to sealingly engage the paint can groove 18 and to prevent the entry of paint or other fluid contained by the can 14, while the lid 10 is positioned on the can rim 16. The outer and inner circular flanges 22 and 24 are so sized and radially spaced from one another such that they span the rim 16 and grippingly engage the inner and outer walls of the paint can rim 16 to provide a secure and tight fit.

The planar member 20 further comprises a central square-shaped opening 26 which permits entry into the interior of the paint can with a paint brush. A pouring spout 28 is integrally attached to the planar member 20 such that the bottom edges of the pouring spout 28 define two of the adjacent edges of the square aperture 26. The remaining edges of the square aperture, namely, edges 29 and 30, define paint brush wiping surfaces as it can be seen that the flat surfaces provide a simple and unique means for wiping a brush so as to remove the excess paint from a brush thereby providing a neater and more even distribution of the paint on the brush, all of which results in less dripping of paint from the brush when removed from the can as well as neater trim work when the brush is used for such purposes.

Figure 2:
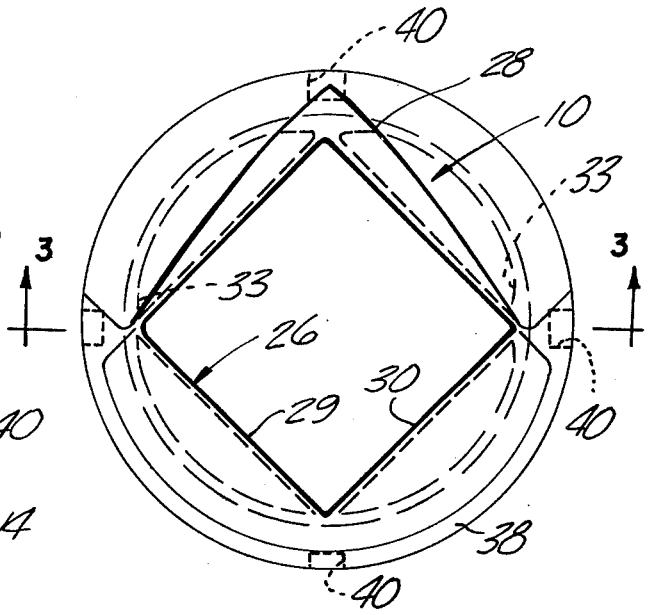
FIG. 2 is a top plan view of the pouring spout lid illustrated in FIG. 1 with the cover removed.
Figure 3:
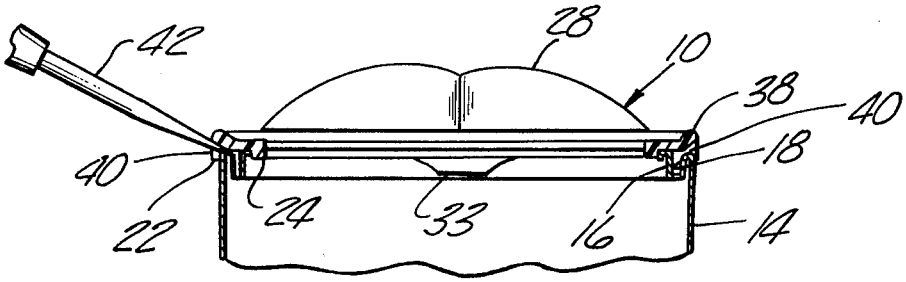
FIG. 3 is a fragmentary cross-sectional view of the lid and container taken along Line 3—3 of FIG. 2.
Figure 4:
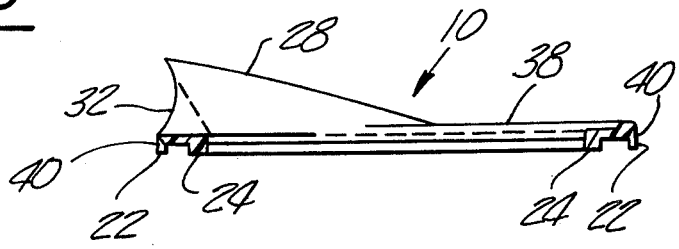
FIG. 4 is a partially sectioned side elevational view of the pouring spout lid illustrated in FIGS. 1–3 of the drawing.

As can best be seen in FIG. 4, the forward end of th spout 28 is provided with a web 32 which provides structural support for the same. As can best be seen in FIGS. 1, 2, and 3, each corner of the square opening 26 is provided with weirs 33 which extend slightly below the planar surface 20 to provide a barrier to permit the tangential stirring of the liquid within the container without concern for the paint overflowing from the can through the opening 26.

The lid 10 further comprises a peripheral bead 38 which extends from the lower side edges of the spout 28 and along the outer edge of the paint can adjacent the opening 26 and provides a raised barrier to prevent the spilling of paint from within the lid 10 in the event some paint does spill onto the top surface of the planar member 20.

To facilitate the ease of removing the lid 10 from the top of the paint can which, as aforementioned, engages the paint can in a snap-lock fashion, the side wall of the planar member 20 is provided with a plurality of parting apertures 40 which extend through the outer flange 22 and into the channel defined between the outer and inner flanges. These parting apertures 42 provide a simple means for inserting a suitable device such as a screwdriver end 42 through the lid 10 and under the planar surface 20 so that the screwdriver 42 may bear down against the paint can rim 16, while the end of the screwdriver 42 forces the lid 10 off of its snap-lock engagement with the can 14 in a manner which permits its removal without concern for tipping the can 14 and spilling the contents therein. A plurality of such parting apertures 40 is provided at strategic locations around the edges of the lid 10 as it will have to be pried open at several such locations in order to insure its complete and safe removal from the can 14.

In the event that the user of the lid 10 needs to temporarily dispense with painting, the inventive device is provided with a cover 12 that permit the user to place the cover 12 over the square opening 26 so as to provide a temporary seal of the fluid therein and prevent its evaporation and/or premature drying while not in use. The cover 12 comprises a top wall 44 having a handle 46 which permits the user to pick it up and place it in the opening 26 and remove it therefrom as desired. The cover 12 has inclined side walls 48 which are formed to define a square opening that is so sized as to sealingly engage the square opening 26 when inserted therein. The inclined side walls 48 of the cover 12 permit a suitable and easy means for obtaining such a seal. The knob 46 of the cover 12 is wide and provided with a flat upper surface such that, when the cover 12 is removed from the aperture 26 of the lid 10, the cover 12 may be positioned upside down using the flat surface of the knob 46 as the supporting means.

The cover 12 is preferably fabricated from a suitable plastic material; however, other means and materials may be employed to provide such a cover.

As aforementioned, the pour spout and brush-wiping lid 10 with its cover 12 according to the present invention may be constructed from suitable known synthetic material, such as low-density polyethylene resin and the like. These materials are suitable for injection molding and are sufficiently flexible and resilient to match tolerances and fit standard containers. Further, such a construction permits the adaptation of the pour spout to various sizes of cans as aforementioned. By the use of a plastic material, the spout and cover will be essentially chemically resistant to and not materially affected by paints, enamels, laquers, sealers, thinners, glues, alcohols, and other conventional, commercial, and industrial cleaners, solvents, and solutions on which the present invention would have application.

It should be understood by those skilled in the art of covers for paint cans and the like that the foregoing description is considered as illustrative only of the principles of the present invention and that numerous modifications and changes will readily occur to those skilled in the art of such paint can covers, and that the disclosure is not desired to limit the invention to the exact construction and operation as shown and described; and, accordingly, all suitable modification and equivalence which may be resorted to will fall within the spirit of the present invention and scope of the appended claims.

What is claimed is as follows:

1. A pour spout lid for fluid containers comprising:

a circular planar member having a square aperture with two edges thereof defining the edges of a spout extending upwardly and outwardly therefrom, the planar member having inner and outer radially spaced circular flanges which define therein between a channel adapted to snap lockingly engage a rim of a conventional fluid-holding container; said planar member being provided with a peripheral bead extending along the edge of said planar member circumscribing said square opening and terminating in integral connection with said pour spout such that said pour spout and said peripheral bead completely surround said square opening;

means defining an opening in said outer circular flange to permit the insertion of a removing means cooperating with said can rim to facilitate the removal of said lid from said container;

a plurality of circumferentially spaced, downwardly extending members disposed at the corners of said square aperture on the bottom side of said planar member to prevent the overflow of fluid from within said container onto the top of said planar member when the fluid contents of said container are tangentially stirred;

a cover having a top wall with inwardly inclined depending side walls of a square configuration, said side walls matingly engaging said square aperture to enclose said aperture; and a handle formed on the top of said top wall to permit the removal of said cover from said square aperture.

* * * * *